United States Patent [19]

Lofthouse et al.

[11] 4,208,277

[45] Jun. 17, 1980

[54] ROTARY RECIPROCATING MAGNETIC SEPARATOR WITH UPWARD FEED

[75] Inventors: Charles H. Lofthouse; David G. Bell; Leyland R. Phillips, Cornwall, all of England

[73] Assignee: English Clays Lovering Pochin & Company Limited, St. Austell, Cornwall, England

[21] Appl. No.: 859,446

[22] Filed: Dec. 12, 1977

[30] Foreign Application Priority Data

Dec. 15, 1976 [GB] United Kingdom ..... 52416/76

[51] Int. Cl.[2] ..... B03C 1/14

[52] U.S. Cl. ..... 209/223 A; 209/232; 210/222

[58] Field of Search ..... 209/222, 214, 223, 232, 209/217, 223 A; 210/220, 223

[56] References Cited

U.S. PATENT DOCUMENTS

| | | | |
|---|---|---|---|
| 731,446 | 6/1903 | Forsgren | 209/217 |
| 1,093,875 | 4/1914 | Mottinger | 209/232 X |
| 2,398,725 | 4/1946 | Schulte | 209/232 X |
| 2,508,666 | 5/1950 | Frantz | 209/232 X |
| 2,754,000 | 7/1956 | Pietz | 218/222 |
| 2,834,470 | 5/1958 | Jones | 210/222 |
| 3,326,374 | 6/1967 | Jones | 209/214 |
| 3,375,925 | 4/1968 | Carpenter | 209/214 |
| 3,380,589 | 4/1968 | Gray | 209/231 X |
| 3,627,678 | 12/1971 | Marston | 210/222 |
| 3,830,367 | 8/1974 | Stone | 209/222 X |
| 3,849,301 | 11/1974 | Reading | 209/232 X |
| 3,920,543 | 11/1975 | Marston | 209/222 |
| 4,054,513 | 10/1977 | Windle | 210/222 |
| 4,087,358 | 5/1978 | Oder | 209/214 |
| 4,124,503 | 11/1978 | Watson | 209/222 X |

*Primary Examiner*—Robert Halper

*Attorney, Agent, or Firm*—Weingram & Klauber

[57] ABSTRACT

A rotary magnetic separator is disclosed which includes a ferromagnetic rotor provided with a plurality of arcuate separating chambers supported at its periphery. Each separating chamber comprises an inlet for feed suspension in its bottom coupled to a pump by way of a flexible pipe, and an outlet for feed suspension in its top, there being a fluid permeable and magnetizable packing material between the inlet and outlet. Two electromagnet poles are magnetically coupled to the rotor which serves as a further pole. The rotor can be turned by a motor so as to move certain separating chambers into the vicinity of the electromagnet poles. Feed suspension can then be supplied to these separating chambers and magnetizable particles from the feed suspension may become entrained in the packing material. Subsequently the rotor can be turned back to its original position and these separating chambers can be flushed out with clean water.

12 Claims, 9 Drawing Figures

ROTARY RECIPROCATING MAGNETIC SEPARATOR WITH UPWARD FEED

BACKGROUND OF THE INVENTION

This invention relates to a magnetic separator for, and a method of, magnetically separating magnetisable particles from a fluid.

A conventional magnetic separator generally comprises a separating region containing a magnetisable packing material which, in operation, is magnetised by the application of a magnetic field to provide a large number of "collecting sites" of high magnetic field intensity within the packing material. In use of the separator, a feed suspension of magnetisable and substantially non-magnetisable particles in a fluid is introduced into the packing material. A large proportion of the magnetisable particles of the suspension are magnetised and attracted to the collecting sites, whilst the bulk of the substantially non-magnetisable particles pass out of the packing material. The magnetisable particles entrained in the packing material are subsequently removed externally of the magnetic field.

British Pat. No. 1,054,807 (G.H. Jones) describes and claims a rotary magnetic separator for separating solid magnetisable particles from a fluid in which they are suspended, the separator including a stator comprising a plurality of pairs of poles arranged in alternate polarity around the stator so as to provide alternate zones of strong and weak or zero magnetic field, a rotor having a plurality of gaps between walls made of magnetisable material, said rotor being adapted to rotate about a vertical axis such that any part of the rotor will pass through alternate zones of strong and weak or zero magnetic field on rotation, means for feeding the particle carrying fluid into the upper ends of the gaps in zones of strong magnetic field, means for collecting the fluid which has passed through the gaps, means for feeding rinsing fluid through the gaps whilst they are still within zones of strong magnetic field so that any non-magnetic particles adhering to the walls are washed off, and means for directing flushing fluid through the gaps in zones of weak or zero magnetic field such that the magnetic particles are removed from the walls of the gaps.

U.S. Pat. No. 3,375,925 (Carpenter) describes and claims a magnetic separator for separating granular materials of differing magnetic susceptibility comprising:

at least one magnet means having oppositely disposed field poles of opposite polarity for producing an effective magnetic field therebetween;

a plurality of loose, unattached induced pole pieces, said induced pole pieces being individually means for carrying and retaining the induced pole pieces, movable relative to each other;

means for moving the induced pole pieces and the field poles relative to each other so that the induced pole pieces pass into, through and out of the effective magnetic field;

means for introducing the material to be separated into the effective magnetic field and therein into proximity with the induced pole pieces as the pieces pass through the field; and means for flushing material from proximity with the induced pole pieces after the pieces have passed out of the effective magnetic field.

In all the embodiments described, the feed material is allowed to fall by gravity into an open-topped box containing the induced pole pieces and the product and waste streams flow through the open bottom of the box into suitable receiving launders.

SUMMARY OF THE INVENTION

According to one aspect of the present invention, there is provided a magnetic separator comprising:

(a) magnet means for establishing a magnetic field in at least one first zone;

(b) a rotor provided with a plurality of separating chambers each supported at a distance from the axis of rotation of the rotor, each separating chamber containing a fluid permeable and magnetisable packing material and being provided with an inlet for feed suspension in a lower region thereof and an outlet in an upper region thereof;

(c) moving means for turning the rotor to move the separating chambers into and out of the first zone(s);

(d) supply means for supplying feed suspension containing magnetisable particles to the inlet of each separating chamber when that separating chamber is within (one of) the first zone(s); and (e) removal means for removing magnetisable particles retained in the packing material of each separating chamber after that separating chamber has been moved out of (one of) the first zone(s) into a second zone.

The form of the separating chambers and the supply means enable feed suspension to be passed through the separating chambers at a controllable linear velocity. The supply means may include at least one flexible pipe coupled to the inlets of the separating chambers and at least one pump. The supply means preferably comprises a system of pipes and at least one valve on the rotor and at least one pump for supplying this system by way of at least one flexible pipe. It is envisaged that gravity feed may also be utilized provided a sufficient head of fluid is provided.

The separator preferably further comprises rinsing means for supplying rinsing fluid to the inlet of each separating chamber immediately after supply of feed suspension to that separating chamber has ceased and while that separating chamber is still within (one of) the first zone(s), so as to remove any substantially non-magnetisable particles remaining in the packing material. To this end, the rinsing means may comprise a system of pipes and at least one valve on the rotor so as to be rotatable therewith and at least one pump for supplying this system by way of at least one flexible pipe. The system of pipes and the valve(s) are preferably constructed from a lightweight, non-magnetic material. The pipes are advantageously made of a synthetic plastics material, such as polyethylene, polypropylene or poly(vinyl chloride).

Advantageously the removal means includes flushing means for passing flushing fluid, preferably clean water, downwards through each separating chamber when that separating chamber is within (one of) the second zone(s). These means may also include magnetic degaussing means positioned in the second zone(s) for reducing the residual magnetism of the packing material within each separating chamber prior to flushing with a fluid. Preferably the flushing means comprises a system of pipes and at least one valve on the rotor and at least one pump for supplying this system by way of at least one flexible pipe.

In a preferred embodiment of the invention, the inlet and outlet of each separating chamber is so disposed that feed suspension supplied to the inlet passes substantially vertically upwards through the separating chamber, the direction of the magnetic field in the first zone(s) being conveniently in this case horizontal. In an alternative embodiment, the construction of the interior of each separating chamber is such that feed suspension passes through the packing material in a radial direction relative to the axis of rotation of the rotor, in which case the magnetic field in the first zone(s) is preferably parallel to this direction.

Preferably the rotor is in the form of a disc and is constituted at least predominantly by ferromagnetic material. The magnet means is preferably constituted by one or more pairs of conventional electromagnet coils, in which case the magnetic flux may be concentrated in the zone(s) in which it is required by means of the ferromagnetic rotor and a ferromagnetic return frame. The flux density of the magnetic field which is applied by the magnet means, in use, is preferably in the range of 0.5 to 2.5 Tesla although it may be more (in which case a superconducting electromagnet may be necessary).

The packing material may consist of particles such as spheres, pellets of, for example, cubic or cylindrical shape or more irregular particles such as are described in British Pat. No. 1,452,271 (English Clays Lovering Pochin & Company Limited). The regularly shaped particles preferably have a longer dimension in the range from 100 to 2000 μm and are conveniently packed in the separating chamber to a density such that from 25% to 75%, and preferably from 30% to 50%, by volume of the separating chamber is void. The irregular particles preferably have a length ranging from about 50 to 5000 μm and a width ranging from about 20 to 1000 μm and are conveniently packed to a density such that from 30% to 90%, and preferably from 35% to 70%, by volume of the separating chamber is void. Alternatively the packing material may be a filamentary material, such as substantially straight filaments packed singly or in bundles, a randomly orientated material such as steel wool, a woven wire mesh or an expanded metal mat. The larger dimension of the cross-section of the filament would normally be from 25 to 250 μm, preferably from 50 to 100 μm. The packing material may also be a metallic foam of the type disclosed in U.S. patent application Ser. No. 570,626 (German OS No. 25 17 857—English Clays Lovering Pochin & Company Limited). In the case of a filamentary or foam packing material about 60% to 98%, preferably 75% to 97%, by volume of the separating chamber is conveniently void. The packing material is generally ferromagnetic but may in some circumstances be paramagnetic as disclosed in U.S. patent application Ser. No. 597,686 (German OS No. 25 32 305—English Clays Lovering Pochin & Company Limited).

According to another aspect of the present invention, there is provided a method of magnetically separating magnetisable particles from a feed suspension, utilizing a rotor provided with a plurality of separating chambers each supported at a distance from the axis of rotation of the rotor, each separating chamber containing a fluid-permeable and magnetisable packing material and being provided with an inlet for feed suspension in a lower region thereof and an outlet in an upper region thereof, which method comprises:

(a) establishing a magnetic field in at least one first zone;

(b) supplying a quantity of feed suspension to the inlet of a first of the separating chambers disposed within (one of) the first zone(s), so that magnetisable particles within the suspension are magnetised and attracted to the packing material within the first separating chamber, whilst most of the remainder of the suspension passes through the packing material and exits through the outlet;

(c) concurrently with (b), removing magnetisable particles retained in the packing material of a second of the separating chambers in a second zone;

(d) rotating the rotor through a predetermined angle so as to move the first separating chamber out of the first zone and into the second zone or a further second zone, and so as to move the second separating chamber into (one of) the first zone(s);

(e) removing the magnetisable particles retained in the packing material of the first separating chamber within the (further) second zone; and (f) concurrently with (e), supplying a further quantity of feed suspension to the inlet of the second separating chamber within (one of) the first zone(s), so that magnetisable particles within the suspension are magnetised and attracted to the packing material within the second separating chamber, whilst most of the remainder of the suspension passes through the packing material and exits through the outlet;

the magnetic field being continuously maintained in the first zone throughout (b) to (f).

In a preferred embodiment of this method, after step (f) has been completed, the rotor is rotated through an angle equal in magnitude, but opposite in sense, to said predetermined angle so as to move the first and second separating chambers back into their first-mentioned positions. The magnetic field is preferably also continuously maintained in the first zone(s) during this further step. Magnetic separation apparatus which is intended to operate in this manner may be known as a "Reciprocating Carousel Magnetic Separator".

During step (b) of the method described above, the feed suspension is passed through the first separating chamber within (one of) the first zone(s) for a time such that the total concentration of magnetisable particles in the substantially non-magnetisable product which flows out of the outlet remains within acceptable limits. As the time for which the feed suspension is passed through the separating chamber is increased, so collecting sites in the packing material become occupied by captured magnetisable particles and the number of magnetisable particles which pass right through the separating chamber without being captured increases. After the flow of feed suspension has been stopped, the packing material is preferably rinsed out with rinsing fluid, preferably clean water, flowing in the same direction as the feed suspension and at approximately the same velocity in order to remove any substantially non-magnetisable particles remaining in the packing material. Advantageously the quantity of clean water passed is approximately equal to from one to three times the volume of voidage in the packing of the separating chamber. The second separating chamber within (one of) the second zone(s) is preferably flushed through with a stream of fluid, preferably clean water, at high pressure and high velocity in order to remove the entrained magnetisable particles, for a time which may be less than, but is conveniently equal to the time for which feed suspension and rinsing fluid are passed through the first separating chamber. Preferably the flushing fluid is passed through the separating chamber in the opposite direction to the feed suspension and the rinsing fluid.

The magnetic separator of the present invention is especially suitable for separating discolouring iron compounds from a suspension of a white mineral, such as kaolin, calcium carbonate, titanium dioxide or talc, thus improving the brightness of the product.

In a preferred embodiment of the magnetic separator of the present invention, the rotor is substantially disc shaped and is provided with four separating chambers spaced around its periphery. In such a separator a continuous magnetic field is preferably provided in two first zones in use of the apparatus, and two second zones are provided in which the magnetic field is substantially zero and within which magnetisable particles may be removed from a separating chamber. In use of such apparatus, a separating chamber is initially disposed in each of the above mentioned zones. When sufficient feed suspension has been supplied to the two separating chambers disposed in the two first zones in which a magnetic field is applied, the rotor is rotated through 90° to move these separating chambers into the second zones and to move the other two separating chambers from the second zones into the first zones in which a magnetic field is applied. When sufficient feed suspension has been supplied to these two separating chambers, the rotor is rotated by 90° in the opposite sense to the previous rotation so as to bring all the separating chambers back to their initial positions. Thus two separating chambers are disposed in a magnetic field at all times of the separation process, except when the rotor is actually being rotated.

BRIEF DESCRIPTION OF THE DRAWINGS

In order that the present invention may be more fully understood, a constructional example of magnetic separator according to the present invention will now be described with reference to the accompanying drawings, in which.

DETAILED DESCRIPTION OF THE DRAWINGS

Figure 1:
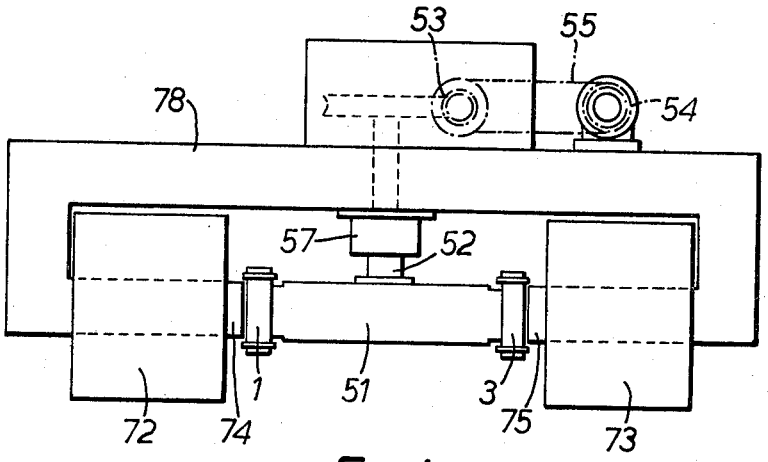
FIG. 1 is a diagrammatic side elevation of the magnetic separator.
Figure 2:
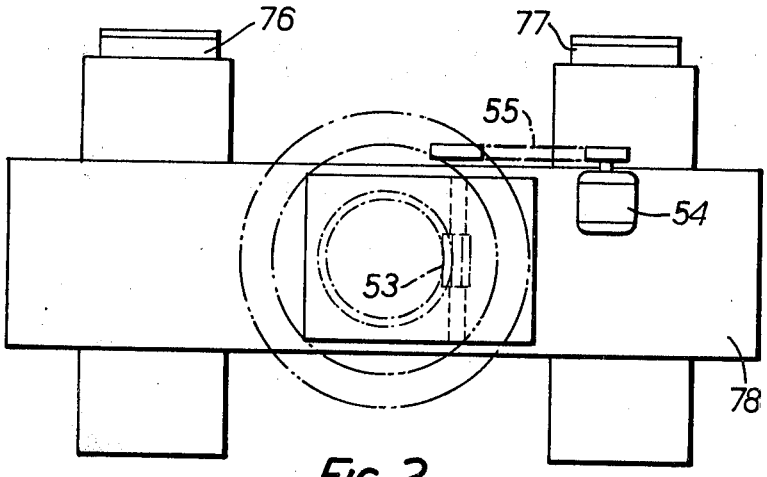
FIG. 2 is a plan view of the magnetic separator.

Referring first to FIGS. 1, 2, 5 and 6, the magnetic separator shown therein comprises a rotor in the form of a central plate or disc 51 of ferromagnetic material, preferably iron, mounted on a shaft 52 which is provided with a bearing 57 and which may be rotated by reciprocating means in the form of a worm drive gear 53 driven by an electric motor 54 fitted with a speed reducing gear through a belt drive 55. To the periphery of the disc 51 there are bolted four separating chambers 1, 2, 3 and 4. Each separating chamber is made of non-magnetic stainless steel and has an arcuate shape, the length of the arc being a little less than one quarter of the circumference of the disc 51. Each chamber is provided with six lugs 60 which co-operate with pivoted bolts 61 on the disc 51 (see FIG. 3). The lugs 60 are provided with vertical slots to permit easy release from the pivoted bolts 61. Each separating chamber is filled with a packing material 79 (see FIG. 3) consisting of ferromagnetic stainless steel wool which is compressed to give a voidage of 95% by volume.

Figure 3:
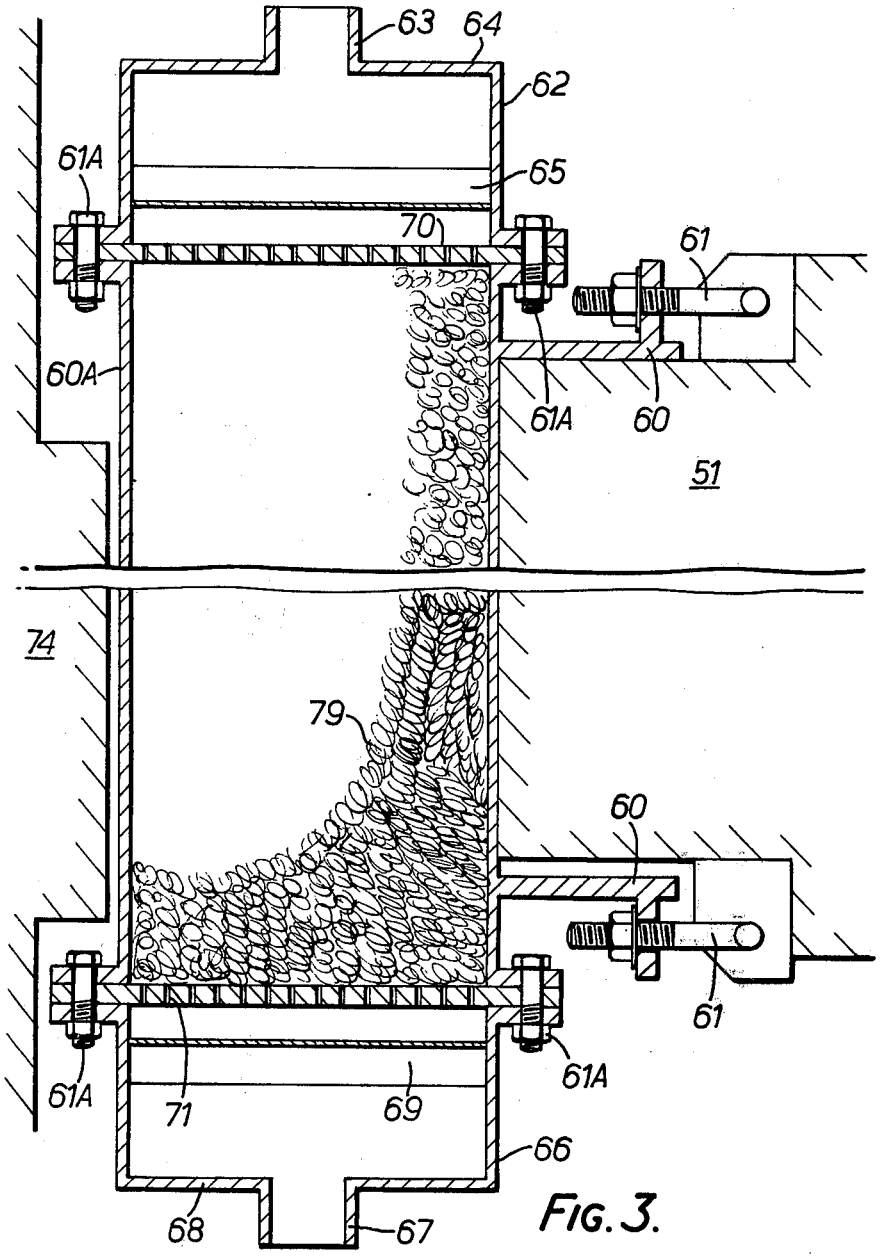
FIG. 3 is a sectional side elevation of a separating chamber of the magnetic separator.
Figure 4:
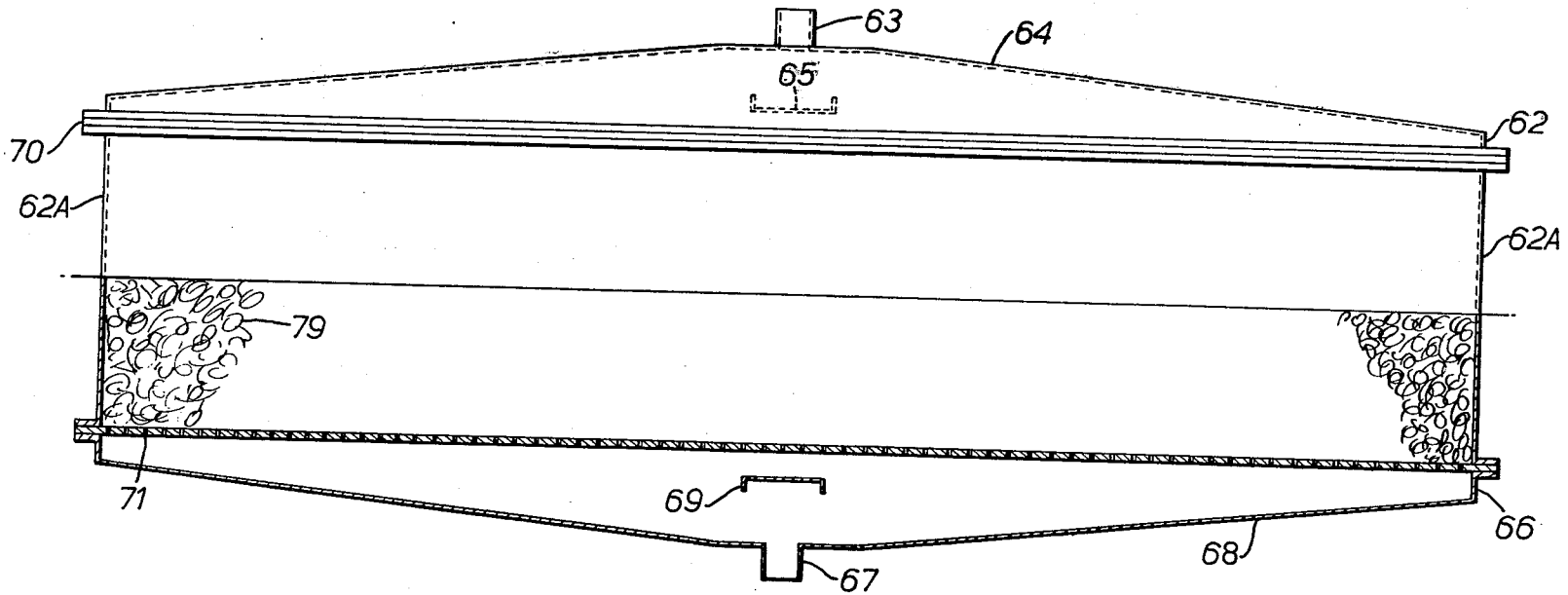
FIG. 4 is a front elevation, partly in section, of a separating chamber of the magnetic separator.

In the embodiment of separating chamber illustrated in FIGS. 3 and 4, detachable top and bottom sections 62, 66 are secured to the main body 60A of the separating chamber by nuts and bolts 61A. The top section 62 is provided with a central outlet 63 for product suspension and the upper wall 64 slopes down on either side of the outlet 63 to meet the top of the end walls 62A of the chamber (see FIG. 4). A rectangular flanged plate 65 is welded across the top section 62 just below the outlet 63. The sloping upper wall 64 and the rectangular plate 65 co-operate to provide a substantially uniform flow of suspension or flushing water through the packing material 79. The bottom section 66 of the separating chamber is similarly shaped to the top section 62, having a central inlet 67 for feed slurry, a sloping lower wall 68 and a rectangular flanged plate 69. The packing material is confined between upper and lower distribution plates 70 and 71, each of which comprises a polyurethane plate perforated with a large number of small holes. The distribution plates 70, 71 also act as gaskets between the top and bottom sections 62, 66 and the main body 60A of the separating chamber. In an alternative embodiment of separating chamber (not illustrated), the top and bottom sections are made in one piece with the main body of the separating chamber and the two rectangular end walls detachable to enable the packing to be inserted and removed.

In use of the separator, a magnetic field which preferably has a flux density of the order of 0.7 to 0.8 Tesla is established in first zones occupied by two of the four separating chambers by means of electromagnet coils 72 and 73 (FIG. 1). The magnetic field is concentrated in the zones in which it is required by means of pole pieces 74 and 75, which have their outer surfaces shaped to conform to the outer walls of the separating chambers and the disc 51. In FIGS. 1, 6, 7, 8 and 9, separating chambers 1 and 3 are in first zones in which the magnetic field is established and separating chambers 2 and 4 are in second zones midway between the two pole pieces 74, 75 where the magnetic field is almost zero. The coils 72 and 73 are air-cooled by means of fans 76 and 77 (see FIG. 2).

The motor 54, worm drive gear 53 and bearing for the shaft 52 are supported by a heavy iron framework 78 which also serves as a return frame for the magnetic flux generated by the coils 72 and 73. This framework 78 is also magnetically coupled to the ferromagnetic disc 51 which serves as a further pole piece.

Figure 7:
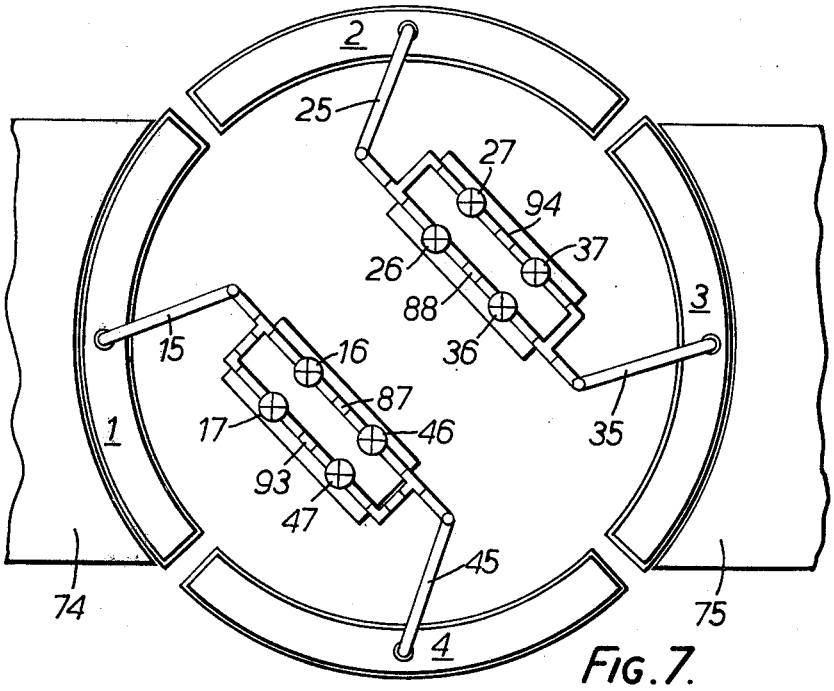
FIG. 7 shows an arrangement of valves and pipes on the upper side of the rotor.
Figure 8:
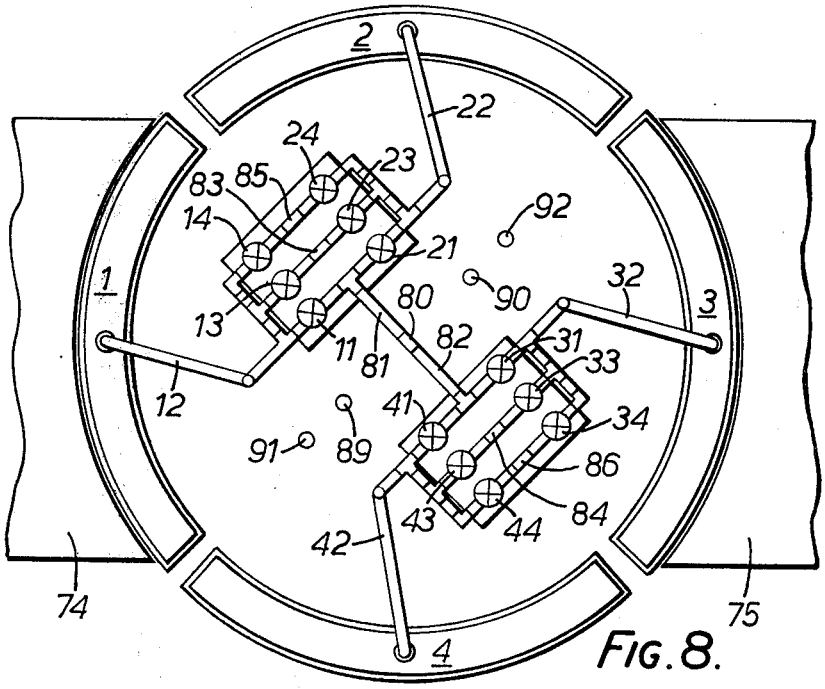
FIG. 8 shows an arrangement of valves and pipes on the lower side of the rotor.
Figure 9:
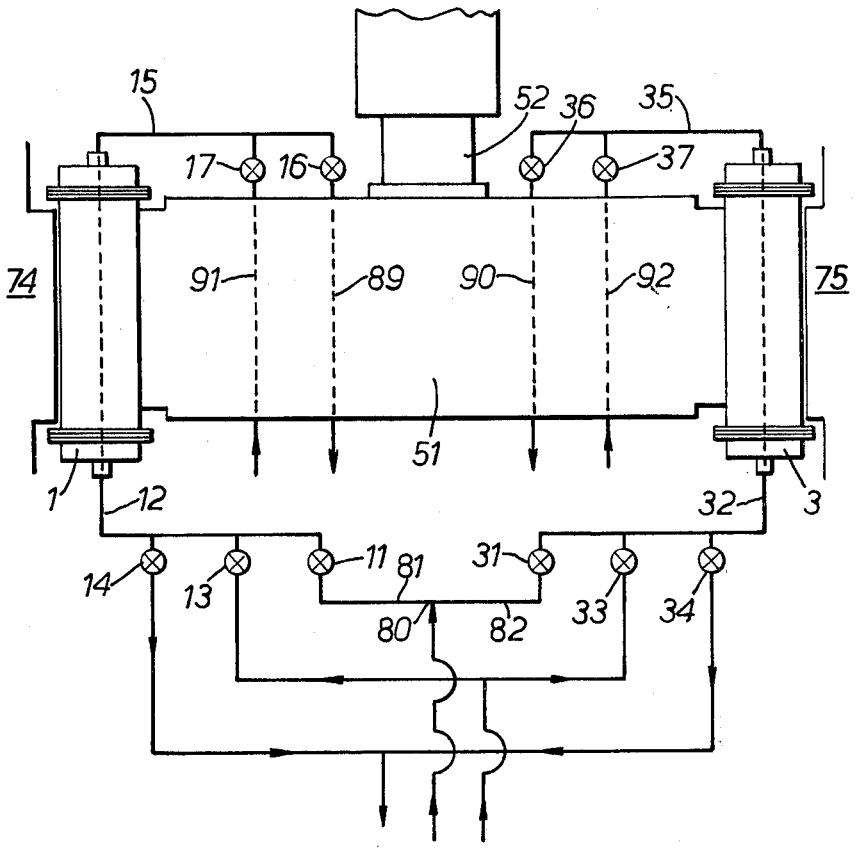
FIG. 9 is a diagram of the system of valves and pipes of the magnetic separator.

Feed suspension, rinsing water and flushing water are fed to the separating chambers and product suspension and flushing water containing magnetisable particles in suspension are conducted therefrom by the system of pipes and valves which is shown diagrammatically in FIGS. 7, 8 and 9. The pipes are of 1 inch B.S.P. poly(vinyl chloride) piping and joints are made with an appropriate adhesive. The valves are pneumatically operated ball valves which give on-off control but exert no throttling action. FIG. 7 shows an arrangement of pipes and valves above the disc 51 and FIG. 8 shows an arrangement of pipes and valves below the disc 51. Referring to FIGS. 8 and 9, feed suspension is supplied to a central T-piece 80 from below by way of a pump and a flexible pipe. From the T-piece 80 it is distributed by a pipe 81 towards separating chambers 1 and 2 and by a pipe 82 towards separating chambers 3 and 4. Valves 11, 21, 31 and 41 control the flow of feed suspension from the pipes 81 and 82 to pipes 12, 22, 32 and 42 respectively connected to the inlets 67 of separating chambers 1, 2, 3 and 4 respectively. Rinsing water is supplied to a T-piece 83 to serve separating chambers 1 and 2 and to a T-piece 84 to serve separating chambers 3 and 4, in each case from below by way of a pump and a flexible pipe. Valves 13, 23, 33 and 43 are provided to control the flow of rinsing water to separating chambers 1, 2, 3 and 4 by way of the pipes 12, 22, 32 and 42 respectively. A T-piece 85 is provided for the discharge of the magnetic fraction, which consists of a suspension of magnetisable particles in flushing water, from separating chambers 1 and 2 and a T-piece 86 is provided for the discharge of the magnetic fraction from separating chambers 3 and 4, the discharge in each case taking place via a flexible pipe. Valves 14 and 24 are provided for connecting separating chambers 1 and 2 to the T-piece 85 via the pipes 12 and 22 respectively and valves 34 and 44 are provided for connecting separating chambers 3 and 4 to T-piece 86 via the pipes 32 and 42 respectively.

Referring to FIGS. 7 and 9, on the upper side of the disc 51, pipes 15, 25, 35 and 45 connect the outlets 63 of separating chambers 1, 2, 3 and 4 respectively to one or the other of two sets of valves. Valves 16 and 46 are provided for connecting separating chambers 1 and 4 via pipes 15 and 45 to a T-piece 87 which is connected to a pipe 89 (see FIG. 8) passing through the disc 51. Valves 26 and 36 are provided for connecting separating chambers 2 and 3 via pipes 25 and 35 to a T-piece 88 which is connected to a pipe 90 (see FIG. 8) passing through the disc 51. Pipes 89 and 90 conduct away the product suspension, which consists of an aqueous suspension of substantially non-magnetisable particles, by way of flexible pipes. Flushing water at high pressure is brought to separating chambers 1 and 4 via a pipe 91 (see FIG. 8) and to separating chambers 2 and 3 via a pipe 92 (see FIG. 8), both pipes passing upwards through the disc 51 and being supplied from below by flexible pipes. Pipe 91 terminates in a T-piece 93 which serves separating chamber 1 through a valve 17 and the pipe 15 and separating chamber 4 through a valve 47 and the pipe 45. Similarly pipe 92 terminates in a T-piece 94 which serves separating chamber 2 through a valve 27 and the pipe 25 and separating chamber 3 through a valve 37 and the pipe 35.

Figure 5:
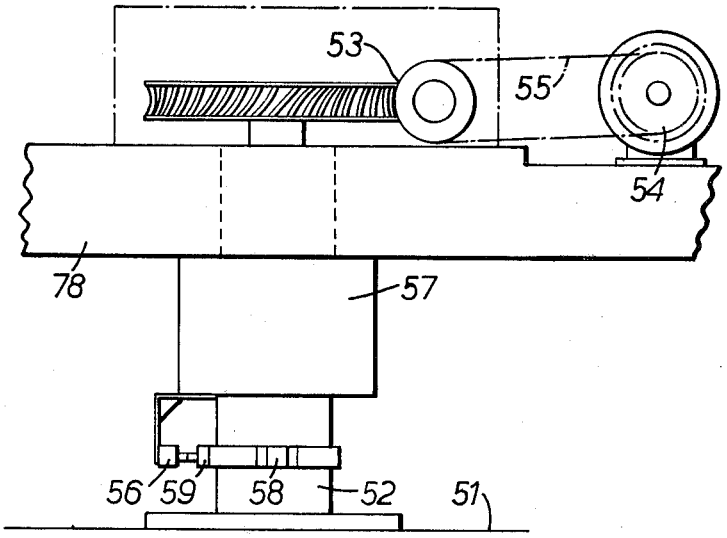
FIG. 5 is a diagram of an upper part of the magnetic separator showing means for turning the rotor through a given angle.
Figure 6:
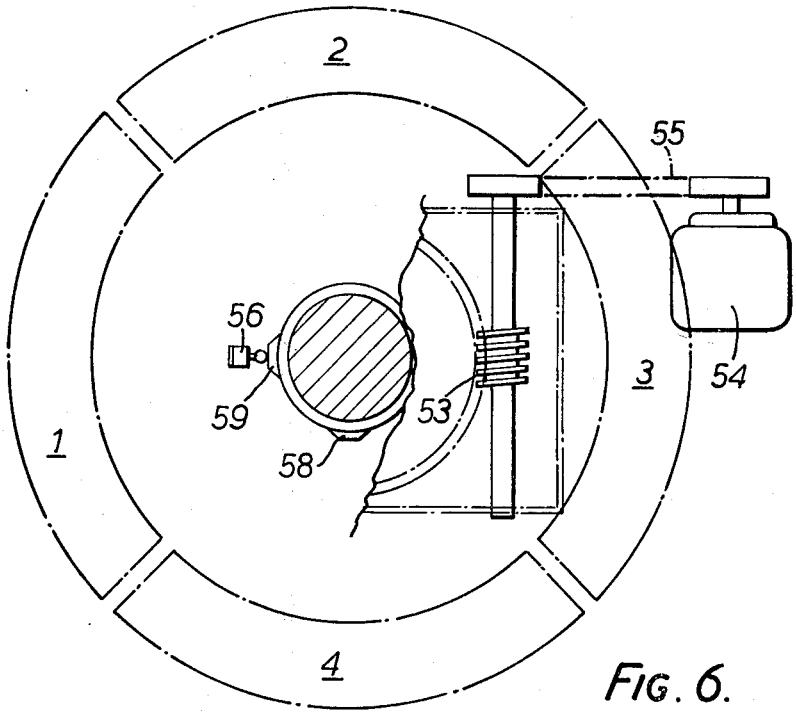
FIG. 6 is a plan view of the magnetic separator partly in section, showing the means for turning the rotor.

Referring to FIGS. 5 and 6, the positions of the separating chambers may be interchanged by turning the rotor through 90° by energising the electric motor 54 and driving the rotor clockwise (as seen in FIG. 6) until a microswitch 56 carried on the housing of the bearing 57 for the shaft 52 is tripped by a first cam 58 on the shaft 52, thus de-energising the motor 54. The separating chambers may be returned to their original positions by energising the electric motor 54 in the opposite sense and driving the rotor anticlockwise until the microswitch 56 is tripped by a second cam 59 on the shaft 52.

An operating cycle may be considered to begin when separating chambers 1 and 3 are positioned in first zones between pole pieces 74 and 75. These separating chambers 1 and 3 have had their packing material 79 freed from magnetisable particles by flushing with high pressure water in the zones of substantially zero magnetic field, and separating chambers 2 and 4 are loaded with magnetisable particles having just undergone the part of a cycle in which magnetisable particles are extracted from the feed suspension. The valves 11, 31, 16 and 36 are opened to permit feed suspension to flow upwards through separating chambers 1 and 3 at the velocity required for the particular separation in hand and to permit product suspension containing predominantly nonmagnetisable particles to be discharged from the separating chambers 1 and 3 through the pipes 89 and 90. At the same time the valves 27, 24, 47 and 44 are opened to allow flushing water at high pressure to flow downwards through the separating chambers 2 and 4 and the magnetic fraction consisting of a suspension of magnetisable particles in water to be discharged via the T-pieces 85 and 86.

After a time which has been found by experiment to be such that the total amount of magnetisable impurities in the product suspension has not risen above an acceptable level, the valves 11 and 31 are closed and the valves 13 and 33 are opened to allow rinsing water to flow upwards through the separating chambers 1 and 3 via the pipes 12 and 32 in order to rinse away any of the non-magnetisable product remaining in the packing of the separating chambers 1 and 3. At the same time the flushing water continues to flow downwards through separating chambers 2 and 4. The velocity of flow of the rinsing water through the separating chambers 1 and 3 is adjusted to be substantially the same as the velocity of flow of the feed suspension in order not to dislodge any captured magnetisable particles. At the end of a time which has been found experimentally to be the time required to rinse substantially all the non-magnetisable product out of the packing of the separating chambers 1 and 3, the valves 13, 33, 16, 36, 24, 44, 27 and 47 are all closed.

With the magnetic field still applied, the rotor is turned clockwise (as seen in FIG. 6) through 90° by energising the motor 54 until the cam 58 trips the microswitch 56. Separating chambers 2 and 4 thus come within the first zones in which the magnetic field is established and separating chambers 1 and 3 occupy the second zones in which the magnetic field is almost zero.

The valves 21, 41, 26 and 46 are then opened to admit feed suspension to separating chambers 2 and 4 and to permit discharge of product suspension through the pipes 89 and 90. At the same time the valves 17, 37, 14 and 34 are opened to allow flushing water at high pressure to scour out the packing of separating chambers 1 and 3 and to discharge a suspension of magnetisable particles through T-pieces 85 and 86.

After the time required for the magnetic extraction step, the valves 21 and 41 are closed and the valves 23 and 43 are opened to allow rinsing water to flush any non-magnetisable material remaining in the packing of separating chambers 2 and 4 through the pipes 89 and 90.

At the end of the rinsing time, the valves 23, 43, 26, 46, 17, 37, 14 and 34 are all closed and the electric motor 54 is energised to drive the rotor anti-clockwise until the cam 59 trips the microswitch 56, thus de-energising the motor. The cycle is thus completed and separating chambers 1 and 3 are back in position in the first zones and ready to receive feed suspension.

The opening and closing of the valves and energising of the electric motor are controlled by a solid state electronic controller incorporating integrated circuit timers which are adjustable to give the intervals required. As a safety precaution, in case of failure of the microswitch 56, the motor 54 is automatically de-energised after a time which is about 1 second longer than the time normally required to rotate the rotor through 90°, and an alarm is sounded.

The above described apparatus is particularly suitable for separating very small (generally having equivalent spherical diameters less than 10 microns) and weakly magnetisable or paramagnetic particles from a fluid at a generally low throughput rate. Although the throughput rate will depend on the intensity of the magnetic field applied by the conventional electromagnet and the throughflow cross-section, the throughflow velocity of the fluid through the apparatus will generally lie somewhere within the range 5 to about 600 cm/min (bearing in mind that conventional electromagnets are not generally capable of applying magnetic fields above 2.5 Tesla). If higher throughput rates are required it would probably be necessary to use a superconducting electromagnet. However superconducting electromagnets with their associated cryogenic units are expensive and are generally only economically feasible in high output apparatus.

The form of the above described apparatus is particularly advantageous since two separating chambers may be accommodated in two different zones in which a magnetic field is applied simply by means of two pole pieces and a central ferromagnetic disc. The rotary motion enables the separating chambers to be moved in and out of these zones in a particularly simple manner. Although in the embodiment particularly described the rotary motion is reciprocating, it would also be possible for the rotor to be rotated in only one direction in operation. In this case, instead of fluid being supplied to the rotor by means of flexible pipes, fluid is supplied through pipes connected by means of sliding seals to a static ring main.

Furthermore it is particularly advantageous to pass the feed suspension vertically upwards through the separating chambers since it is important that the flow velocity of the suspension through the separating chambers should be precisely controlled in order to provide efficient separation. It is much easier to control the velocity of a suspension flowing upwardly than it is to control the velocity of a suspension flowing downwards under the action of gravity.

EXAMPLE

A paper filler grade china clay, having a particle size distribution such that 30% by weight consisted of particles having an equivalent spherical diameter larger than 10 microns and 15% by weight consisted of particles having an equivalent spherical diameter smaller than 2 microns and in the form of an aqueous suspension having a solids content of 22% by weight and 0.13% by weight of sodium hydroxide, based on the weight of dry china clay, to deflocculate the clay, was subjected to magnetic beneficiation using the above described apparatus. The pH of the deflocculated aqueous suspension was 7.

The flux density of the magnetic field established in the gaps between the pole pieces 74 and 75 and the disc 51 was 0.7 Tesla and the separating chambers 1, 2, 3, and 4 were packed with magnetic stainless steel wool to a density such that 94% of the volume between the upper and lower distribution plates 70 and 71 was void-age.

The reflectance to violet light of 458 nm wavelength of the dry, powdered untreated clay was 77.5 (MgO=100). The principal discolouring impurities were iron-containing micaceous materials and the amount of these materials present was estimated by measuring the percentage by weight of $K_2O$ and $Fe_2O_3$ in the dry clay. The $K_2O$ content in the untreated clay was 3.10% and the $Fe_2O_3$ content 1.10% by weight.

The feed suspension was passed vertically upwards through the separating chambers in the magnetic field at four different velocities and in each case the percentage by weight of original clay which was recovered in the non-magnetic product, the number of units by which the reflectance to light of 458 nm wavelength increased and the percentages by weight of the original $K_2O$ and $Fe_2O_3$ which were extracted into the magnetic fraction were determined.

In each case the volume of feed suspension passed through each separating chamber was four times the void volume of the packing and the magnetic extraction step was followed by a rinsing step in which a volume of water equal to twice the void volume of the packing was passed through each separating chamber at the same velocity and in the same direction as the feed suspension. At the completion of the rinsing step the positions of the separating chambers were interchanged and the two separating chambers which were moved out of the magnetic field were subjected to a flow of water passing vertically downwards through the packing at high velocity and high pressure to dislodge the captured magnetic particles, and the cycle was then repeated a large number of times over an extended period, the frequency being approximately 11 cycles per hour.

The results are set forth in the Table below:

TABLE

| Flow velocity (cm/min) | Recovery in non-magnetic fraction (% by weight) | Units Gain in reflectance to light of 458 nm wavelength | % by weight extraction of $Fe_2O_3$ | % by weight extraction of $K_2O$ | Duration of run (hours) |
|---|---|---|---|---|---|
| 60 | 98 | 0.9 | 7 | 4 | 48 |
| 40 | 93 | 1.6 | 18 | 11 | 76 |
| 30 | 88 | 2.1 | 28 | 19 | 39½ |
| 20 | 83 | 2.4 | 37 | 26 | 71½ |

These results show that decreasing the flow velocity results in a greater loss of the original material to the magnetic fraction but a better extraction of micaceous impurities and hence a higher brightness of the non-magnetic fraction. The best compromise between recovery and brightness gain occurs for this feed material at a flow velocity of about 30 cm/min.

The dimensions of the magnetic separator described with reference to the drawings and utilized in the above example are as follows:

(a) the mean diameter of the rotor disc 51=46 inches (1.17 m)

(b) the mean distance of each separating chamber from the axis of the rotor disc 51=25.5 inches (648 mm)

(c) the radial width of each separating chamber=5 inches (127 mm).

(d) the mean arcuate length of each separating chamber = 37.1 inches (943 mm)

(e) the distance between the distribution plates 70 and 71 of each separating chamber = 13 inches (330 mm).

(f) the distance between the inlet 67 and the outlet 63 of each separating chamber = 17.75 inches (451 mm).

(g) the spacing between adjacent separating chambers = 2.9 inches (75 mm)

It would of course be possible to construct larger or smaller magnetic separators of similar design. It is possible to build a machine having a rotor diameter as large as 12 feet (3.7 m) although, for such a large machine, it would be preferable to modify the design. The number of separating chambers could be increased to say 8 or 12. Furthermore the central ferromagnetic disc would preferably not be rotatable with the separating chambers in view of its very large size and weight. Instead the rotor could comprise a ring of separating chambers rotatable about a central axis by means of suitable spider arrangements. It is envisaged that machines having separating chambers of radial width in the range from 2 inches (50 mm) to 16 inches (400 mm) and distance between distribution plates in the range from 6 inches (150 mm) to 30 inches (760 mm) would be feasible.

An alternative embodiment of the present invention to that shown in the drawings is one in which each separating chamber has a similar external form to the separating chamber shown in FIGS. 3 and 4, but in which the distribution plate 71 is replaced by a plate which is perforated only in an inner radial region. This plate enables feed suspension to pass into an inner distribution chamber defined between the inner curved wall of the separating chamber and an inner curved distribution plate. The packing material is contained between this distribution plate and an outer curved distribution plate, the latter defining with the outer curved wall of the separating chamber a collection chamber for feed suspension. The distribution plate 70 of FIGS. 3 and 4 is replaced by a plate which is perforated only in an outer radial region. In such an embodiment the feed suspension passes through the packing material in a substantially radial direction (with perhaps a slight upward component), the applied magnetic field preferably being parallel to this direction.

What we claim is:

1. A magnetic separator comprising:

(a) magnet means for establishing a magnetic field in at least one first zone;

(b) a rotor provided with a plurality of separating chambers each supported at a distance from the axis of rotation of the rotor, each separating chamber containing a fluid permeable and magnetisable packing material and being provided with an inlet for feed suspension in a bottom region thereof and an outlet in a top region thereof;

(c) supply means including at least one flexible pipe coupled to the inlets of the separating chambers, which supply means is provided for supplying feed suspension containing magnetisable particles to the inlet of each separating chamber when that separating chamber is within (one of) the first zone(s);

(d) reciprocating means for turning the rotor first one way and then the other way through a limited angle so as to move the separating chambers into and out of the first zone(s); and (e) removal means for removing magnetisable particles retained in the packing material of each separating chamber after that separating chamber has been moved out of (one of) the first zone(s) into a second zone.

2. A magnetic separator according to claim 1, wherein the supply means further includes at least one pump.

3. A magnetic separator according to claim 2, wherein the supply means comprises a respective pipe coupled to the inlet of each separating chamber, a respective valve incorporated in each of said pipes and mounted on the rotor, and at least one pump for supplying said pipes with feed suspension by way of at least one flexible pipe.

4. A magnetic separator according to claim 1, wherein the limited angle is 90°.

5. A magnetic separator according to claim 1, wherein the rotor is in the form of a disc and is constituted at least predominantly by ferromagnetic material.

6. A magnetic separator according to claim 5, wherein the magnet means comprises at least one electromagnet coil magnetically coupled to the rotor by a ferromagnetic return frame.

7. A magnetic separator according to claim 6, wherein four arcuate separating chambers are spaced around the periphery of the rotor and two electromagnetic coils interconnected by a common ferromagnetic return frame are provided for applying magnetic fields in two first zones.

8. A magnetic separator according to claim 1, wherein the removal means includes flushing means for passing flushing fluid downwards through each separating chamber when that separating chamber is within (one of) the second zone(s).

9. A magnetic separator according to claim 8, wherein the flushing means comprises a respective pipe coupled to the outlet of each separating chamber, a respective valve incorported in each of the said pipes and mounted on the rotor, and at least one pump for supplying said pipes with flushing fluid by way of at least one flexible pipe.

10. A magnetic separator according to claim 1, further comprising rinsing means for supplying rinsing fluid to the inlet of each separating chamber immediately after supply of feed suspension to that separating chamber has ceased and while that separating chamber is still within (one of) the first zone(s).

11. A magnetic separator according to claim 10, wherein the rinsing means comprises a respective pipe coupled to the inlet of each separating chamber, a respective valve incorporated in each of the said pipes and mounted on the rotor, and at least one pump for supplying said pipes with flushing fluid by way of at least one flexible pipe.

12. A magnetic separator according to claim 1, wherein the inlet and outlet of each separating chamber is so disposed that feed suspension supplied to the inlet passes substantially vertically upwards through the separating chamber.

* * * * *